US005868631A

United States Patent [19]

Palonen

[11] Patent Number: 5,868,631

[45] Date of Patent: Feb. 9, 1999

[54] GOLF PUTTER WITH IMPROVED HANDLE

[76] Inventor: Aimo Walfred Palonen, 27260 Irma St., Perris, Calif. 92570

[21] Appl. No.: 971,634

[22] Filed: Nov. 17, 1997

Related U.S. Application Data

[60] Provisional application No. 60/039,673 Feb. 28, 1997.

[51] Int. Cl.[6] ..... A63B 69/36

[52] U.S. Cl. ..... 473/203; 473/204; 473/294

[58] Field of Search ..... 473/293, 294, 473/298, 300, 316, 313, 314, 219, 226, 231, 251, 201, 203, 204

[56] References Cited

U.S. PATENT DOCUMENTS

| | | | |
|---|---|---|---|
| 792,631 | 6/1905 | Taylor . | |
| 1,664,257 | 3/1928 | McCullough | 473/203 |
| 1,919,221 | 7/1933 | Janes . | |
| 2,005,915 | 6/1935 | Grelle . | |
| 2,325,525 | 7/1943 | Lukenbill | 473/201 |
| 3,123,359 | 3/1964 | Lindgren . | |
| 3,462,155 | 8/1969 | Pelz . | |
| 4,215,860 | 8/1980 | Nakamatsu | 473/201 |
| 5,037,103 | 8/1991 | Williams et al. | 273/183 |
| 5,308,073 | 5/1994 | McKoon | 273/187 |
| 5,547,196 | 8/1996 | Izett et al. | 473/242 |
| 5,551,696 | 9/1996 | Izett et al. | 473/226 |

*Primary Examiner*—Sebastiano Passaniti
*Attorney, Agent, or Firm*—Gene Scott-Patent Law & Venture Group

[57] ABSTRACT

The present invention provides a golf club handle for attachment to a golf club shaft having a golf club head. The handle is made of from a single continuous rod or tube and has a pair of hand grip portions which are oriented at an acute angle therebetween so as to enable a person's hands to grasp the handle portions with a relaxed grasp. The handle portions are preferably covered with a molded or applied hand grip having inwardly directed indentations molded into the handle which correspond with the fingers of the human hand.

6 Claims, 1 Drawing Sheet

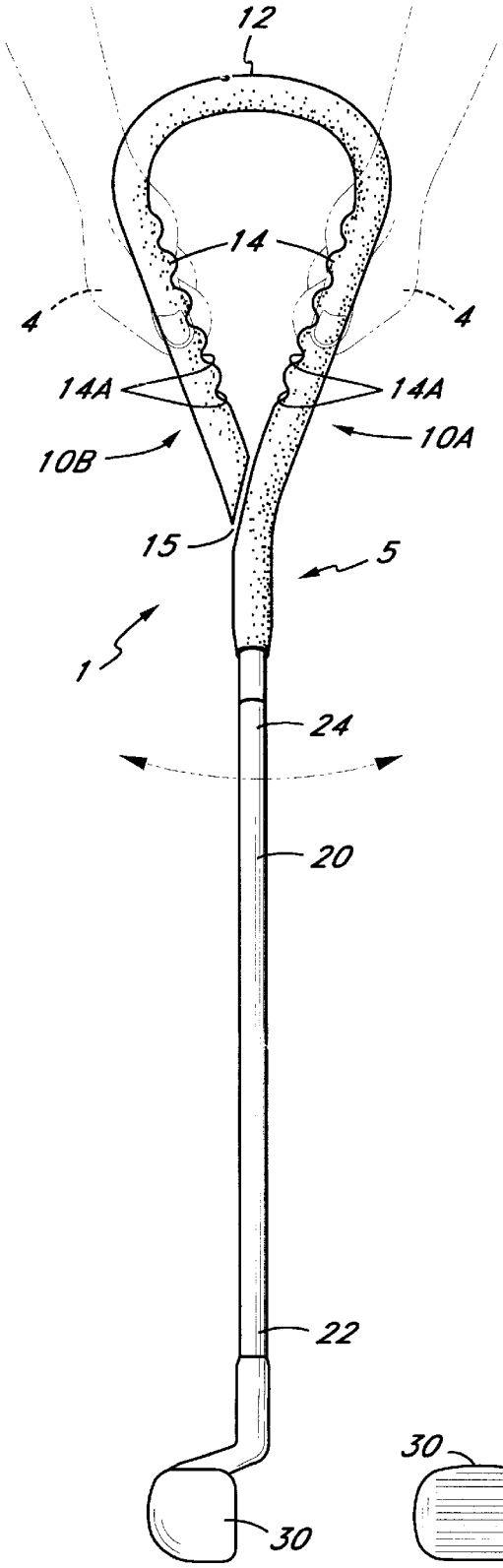
Fig. 1
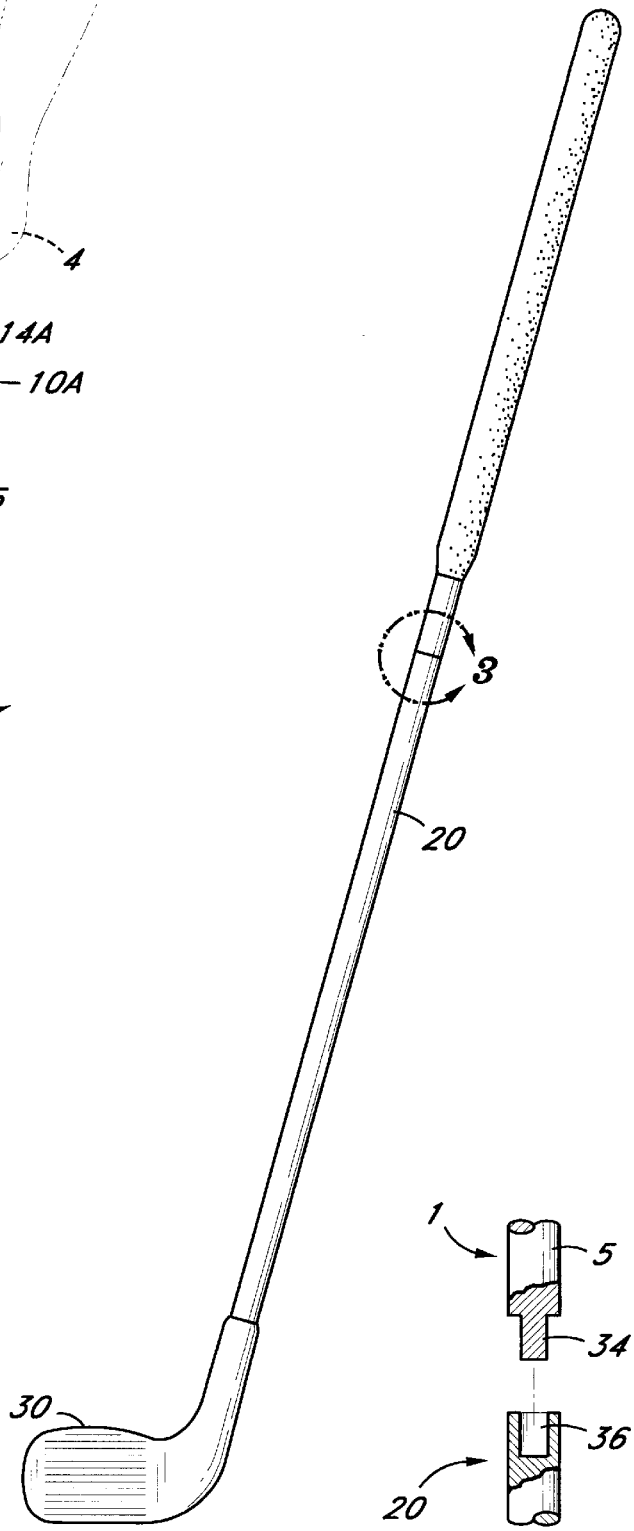
Fig. 2
Fig. 3

GOLF PUTTER WITH IMPROVED HANDLE

This application for a utility patent follows a previously filed provisional patent having the Ser. No. 60/039,673 and a filing date of Feb. 28, 1997.

BACKGROUND OF THE INVENTION

Field of the Invention

This invention relates generally to golf putters, and more particularly to a golf putter with an improved handle for better steadiness in putting.

Description of Related Art

The following art defines the present state of this field:

Williams et al, U.S. Pat. No. 5,037,103, McKoon et al, U.S. Pat. No. 5,308,073, Izett et al, U.S. Pat. No. 5,547,196, and Izett at al, U.S. Pat. No. 5,551,696.

The prior art teaches various putters which can be grasped with two hands. However, the prior art does not teach a golf club having a handle formed from a single continuous shaft formed into a pair of hand grips disposed at an acute angle that is most ergonomically correct for relaxed grasping of the handle in putting or chipping. The present invention fulfills these needs and provides further related advantages as described in the following summary.

SUMMARY OF THE INVENTION

The present invention teaches certain benefits in construction and use which give rise to the objectives described below.

The present invention provides a handle for attachment to a golf club shaft having a golf club head. The handle has a pair of hand grip portions extending at an acute angle therebetween so as to enable a person's hands to grasp the handle portions with a relaxed grasp. The handle portions are preferably covered with a molded or applied hand grip having an inwardly directed finger grasping means such as a plurality of indentations molded into the handle which correspond with the natural positions of the fingers of the hands as they grasp the handle.

A primary objective of the present invention is to provide a golf club with an improved handle having advantages not taught by the prior art.

Another objective is to provide a golf club made from a single shaft and having a pair of handles disposed at an acute angle for swinging a golf club.

A further objective is to provide a golf club which provides the golfer with increased accuracy by eliminating errors due to muscular twitches caused by swinging the club in a manner which is not ergonomically correct or in which the natural arc of the two hands does not mutually correspond.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings:

FIG. 1 is a front elevational view of the preferred embodiment of the present invention, with phantom hands showing how the user is intended to grasp and swing the invention;

FIG. 2 is a side elevational view thereof; and

FIG. 3 is a section taken from partial view 3 in FIG. 2 further showing details of how the handle may be attached to the shaft of the invention.

DETAILED DESCRIPTION OF THE INVENTION

The above described drawing figures illustrate the invention, a golf club handle 1 for attachment to a golf club shaft 20. The handle 1 has a lower portion 5 for attachment to the golf club shaft 20. A pair of linear hand grips 10A and 10B are positioned relative to the lower portion 5 to form an acute angle therebetween so as to enable a person's hands 4 to grasp the hand grips 10A and 10B with an ergonomic relaxed grasp. It is considered an important inventive step in the discovery and applied means of providing the hand grips 10A and 10B in the manner of the instant invention with the terminal end of one of the grips laying adjacent to the lower portion 5, but preferably not touching it as is clearly shown in FIG. 1. It should be noted that a spacing 15 of approximately 0.005 inches or more is preferable. The prior art teaches away from such an embodiment and it has been discovered that just such a configuration as is shown in FIG. 1 avoids the common putting or chipping problem of error introduced by muscle twitching that can disturb an otherwise properly aimed shot.

The handle 1 is preferably made of a rigid material such as steel, aluminum, graphite, titanium or plastic, and is preferably about 18 inches, or less, long. The handle 1 referably has a top portion 12 which connects the hand grips 10A and 10B, to form a loop, as shown in FIG. 1. The hand grips 10A and 10B are preferably covered with a molded or applied hand grip surface 14 which is preferably a compliant material such as a rubber or rubber-like material. In its most preferred embodiment, the hand grip surface 14 includes an inwardly directed finger grasping means 14A. The finger grasping means 14A, as shown in FIG. 1, consists of a plurality of indentations molded into the handle 1 which correspond with a preferred human finger placement when grasping the hand grips 10A and 10B. It is clearly seen in FIG. 1 that the hands 4 are positioned in a manner very similar to that used with the common unitary shaft of a standard putter, except that the wrists are not bent in the rather awkward position necessitated by a unitary shaft. Rather, within the specified angle range of divergence of the portions 10A and 10B, the hands 4 lie in a very natural position with hand and wrist muscles as relaxed as possible.

The handle 1 is capable of attachment to the shaft 20 of a traditional golf putter having a golf club head 30 to form golf club for putting golf balls (not shown). The club is preferably about 35 inches long; however, the length varies from user to user, depending on their height. In the golf club embodiment, the invention has three primary elements: a shaft 20, a golf club head 30, and a handle 1 as described above. The golf club head 30 is attached to a distal end 22 of the shaft. The handle 1 for holding and manipulating the golf club is attached at a proximal end 24 of the shaft 20. The handle 1 extends from the proximal end 24 of the shaft 20 and includes a pair of hand grips 10A and 10B as described above.

In the first embodiment, in which the handle 1 is removably attachable to the shaft 20, the attachment can be accomplished by many joining means as are well known in the art. In its preferred form, as shown in FIG. 3, the lower portion 5 further includes a male rod 34 extending therefrom and which fits into a female portion 36 preferably a hole, in the shaft 20. The female portion 36 is contoured to accept the male portion 34 with a tight frictional fit. In one embodiment, the frictional fit alone keeps the handle 1 attached to the shaft 20. Many other mechanisms including locking screws, set screws, bonding agents such as epoxy cement and other fasteners for locking the handle 1 to the shaft 20 are well known in the art, and this invention should not be construed as being limited to a particular form of attachment.

The shaft 20 and the golf club head 30 are well known in the art, and they are described in greater detail in patents to Izett et al., U.S. Pat. No. 5,551,696, and McKoon et al., U.S. Pat. No. 5,308,073, which are herein incorporated in full by reference. The shaft 20 is preferably thin tubular steel. The golf club head 30 is preferably made of a hard material such as steel, and has a finish which reduces glare.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A golf club handle for attachment to a golf club shaft having a longitudinal axis, the handle comprising:

a lower portion for attachment to a golf club shaft;

an upper portion comprising two hand grips, one of the hand grips extending contiguously from the lower portion, the other of the hand grips being connected to the one of the hand grips;

the hand grips forming an acute angle therebetween greater than zero degrees and lying in a plane substantially perpendicular to the intended direction of putt so as to enable a person's hands to ergonomically grasp the hand grips on opposite sides of the longitudinal axis passing through the golf club shaft, a terminal end of the other of the hand grips laying adjacent to the lower portion.

the hand grips joined by a top portion of the handle for forming a loop structure that is generally centered about the longitudinal axis passing through the golf club shaft.

2. The golf club of claim 1 wherein the top portion of the handle is generally horizontal.

3. The golf club of claim 1 further comprising a finger grasping means on the hand grips.

4. A golf club comprising:

a golf club shaft having a longitudinal axis;

a golf club handle having a lower portion for attachment to the golf club shaft;

an upper portion comprising two hand grips, one of the hand grips extending contiguously from the lower portion, the other of the hand grips being connected to the one of the hand grips;

the hand grips forming an acute angle therebetween greater than zero degrees and lying in a plane substantially perpendicular to the intended direction of putt so as to enable a person's hands to ergonomically grasp the hand grips on opposite sides of the longitudinal axis passing through the golf club shaft, a terminal end of the other of the hand grips laying adjacent to the lower portion.

the hand grips joined by a top portion of the handle for forming a loop structure that is generally centered about the longitudinal axis passing through the golf club shaft .

5. The golf club of claim 4 wherein the top portion of the handle is generally horizontal.

6. The golf club of claim 1 further comprising a finger grasping means on the hand grips.

* * * * *